United States Patent [19]

Roy

[11] 4,134,230

[45] Jan. 16, 1979

[54] MOTORCYCLE RACING STARTING GATE

[76] Inventor: Richard M. Roy, 31 Old Common Rd., Wethersfield, Conn. 06109

[21] Appl. No.: 784,168

[22] Filed: Apr. 4, 1977

[51] Int. Cl.[2] ..... E01F 13/00

[52] U.S. Cl. ..... 49/49; 49/104; 49/131; 272/4

[58] Field of Search ..... 49/131, 49, 33, 379, 49/73, 96, 97, 100, 105, 109, 110, 104; 404/6, 11; 272/3, 4

[56] References Cited

U.S. PATENT DOCUMENTS

| | | | |
|---|---|---|---|
| 1,531,987 | 3/1925 | Smith | 49/96 X |
| 3,994,491 | 11/1976 | Mascotte et al. | 272/4 |

*Primary Examiner*—Kenneth Downey

*Attorney, Agent, or Firm*—Russell M. Lipes, Jr.

[57] ABSTRACT

A starting gate for motorcycle racing of the moto-cross type including a plurality of individual U-shaped members each of which can be raised to a cocked position ahead of the front wheel of a racing motorcycle, a camming device for maintaining the member in cocked position and permitting the release of the member to allow it to drop by gravity towards and out of the way of the motorcycle, and an actuator frame having an interconnection for positioning the camming device to cock the member and means for cocking and releasing the camming device, the construction permitting the addition of a number of U-shaped members extending in either direction from the actuator frame to accommodate the starting of a variable number of racing motorcycles.

10 Claims, 6 Drawing Figures

FIG. 5
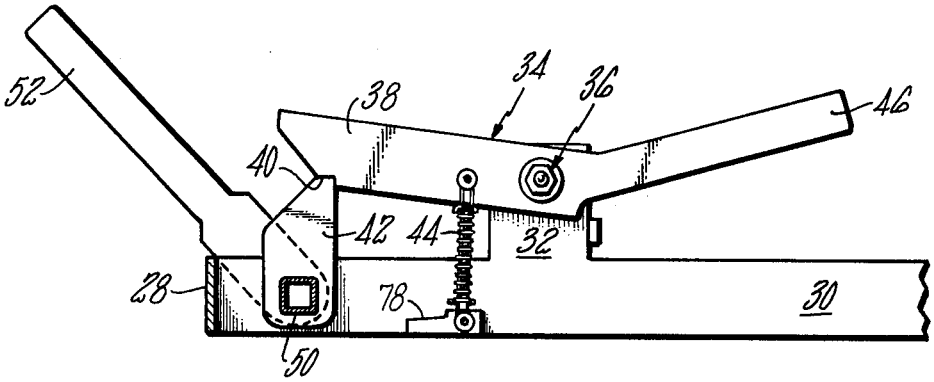
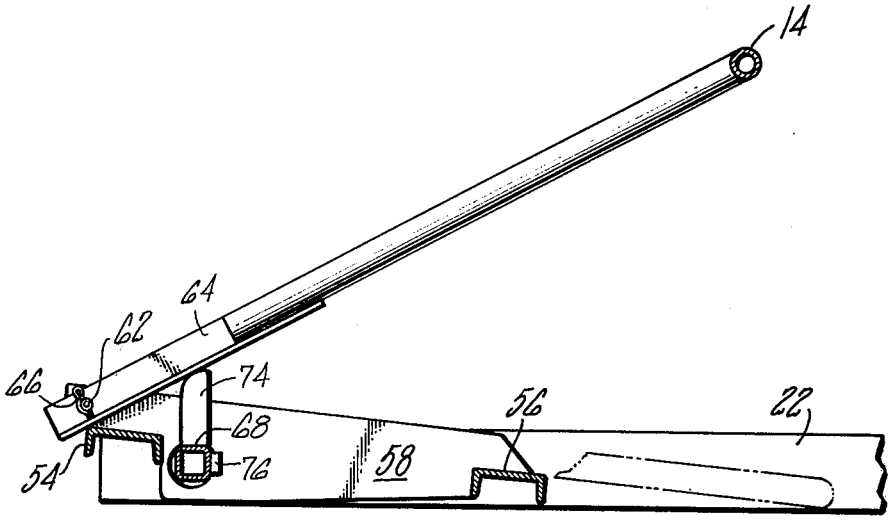
FIG. 6

MOTORCYCLE RACING STARTING GATE

BACKGROUND OF THE INVENTION

1. Field of the Invention

This invention relates to apparatus to be used as a startihg gate for motorcycle racing, and more particularly to a starting gate which permits fair starts and avoids the many frustrations of false starts as frequently experienced in moto-cross racing events.

2. Description of the Prior Art

In motorcycle racing, a variety of starting devices and techniques has been used. These include a starting flag, a starting light, a stretched rubber band, and other types of apparatus including gate structures. These devices generally do not prevent jumping the start by one or more motorcycle racer, or entanglement with the apparatus as in the case of a rubber band. Further, it is possible with most starting devices for one or more racer to make a false start in order to clear his engine. Both the inherent shortcomings of current starting devices plus the false start problems tend to delay a motorcycle racing program to the dismay of racers, spectators, sponsors and officials.

SUMMARY OF THE INVENTION

An object of the present invention is to provide an improved starting gate for motorcycle racing.

Another object of the invention is to provide a motorcycle starting gate which permits the fairest possible starts.

Another object of the invention is to provide a motorcycle starting gate which is mechanically simple, dependable, can be set-up and taken down in a relatively short time, and requires no tools.

Still another object of the invention is to provide a starting gate for motorcycle racing which is easily expendable to accommodate a variable number of motorcycle racers, can be cocked from one location, and which has no readily visible mechanical movements initiating release.

The foregoing and other objects, features and advantages of the invention become more apparent in the light of the following detailed description of a preferred embodiment thereof, as illustrated in the accompanying drawing.

BRIEF DESCRIPTION OF THE DRAWINGS

FIG. 5 is a view along Section 5—5 in FIG. 4 through the actuator frame showing the gate cocking elements.

FIG. 6 is a view along Section 6—6 in FIG. 4 through the gate frame assembly showing the U-shaped gate in cocked position.

DESCRIPTION OF A PREFERRED EMBODIMENT

Figure 1:
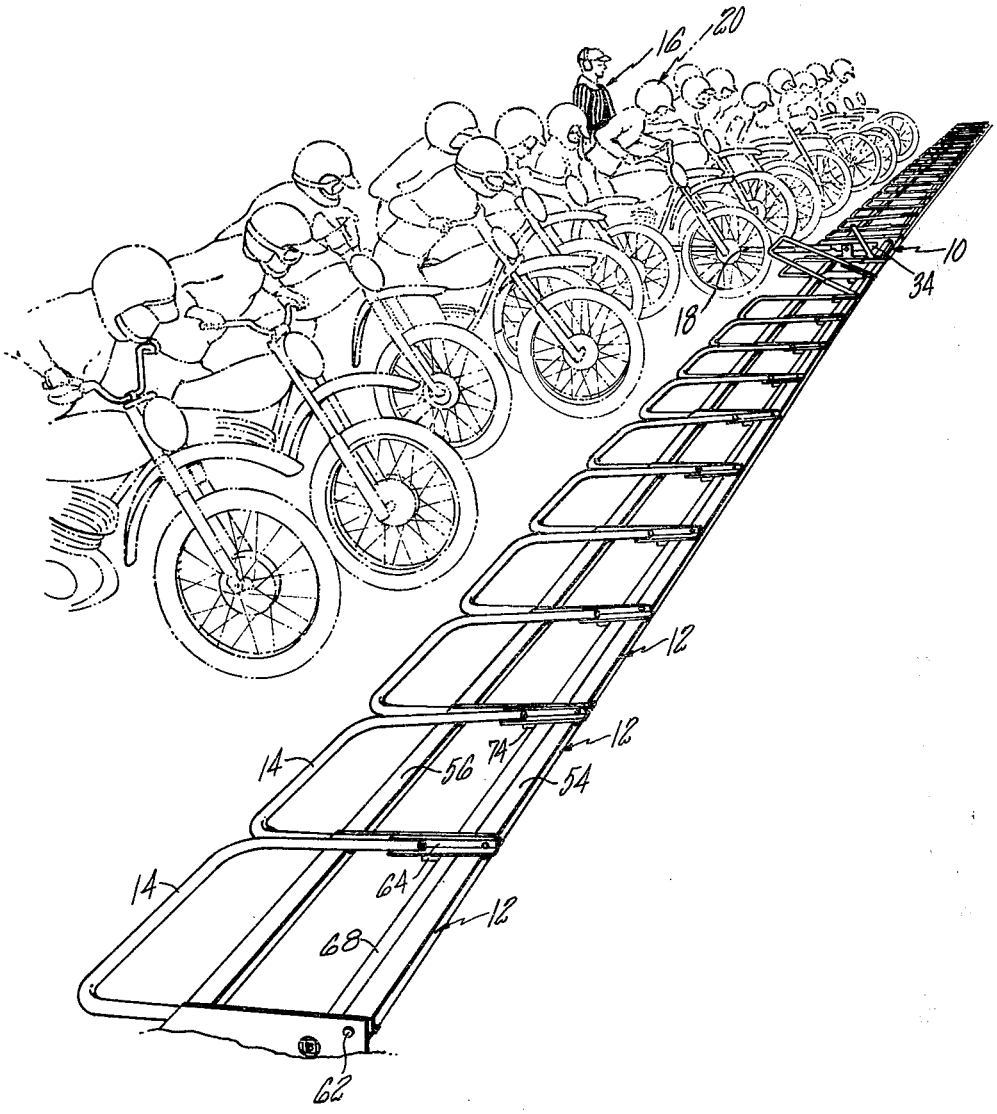
FIG. 1 is a sketch of the gate in use for the start of a motorcycle race, showing one rider who has jumped the start.

Referring to FIG. 1, a gate is shown being used for the start of a race. Actuator frame 10 is located near the center of the starting gate length. A plurality of gate frame assemblies 12 extend in each direction from the actuator frame. A gate frame assembly having six U-shaped gates 14 each defining a starting stall has been found to be convenient, but any multiple of U-shaped gates could be used. The race starter, indicated at 16, is in position behind the motorcycles. He has lowered start handle 18 for the actuator frame mechanism and all but one of the U-shaped gates 14 have dropped to the ground. In this position the motorcycles can pass over the gate elements without hinderance. One motorcycle racer 20, however, attempted to jump the start and the front wheel of his motorcycle has struck the U-shaped gate in his starting lane and further forward movement of the motorcycle has been stopped. Since in its cocked position the U-shaped gate is raised to a position at least as high as the axel of the motorcycle wheel, the wheel is wedged slightly under the U-shaped gate and it will not drop to a start position until the racer has backed his motorcycle away from the U-shaped gate. The U-shaped gate also would not drop at the start if a racer should press the front wheel of his motorcycle against the gate. In the meantime, competing racers who did not attempt to jump-start or press are away from the starting line. Thus, each racer in effect has his own stall, and, if he should attempt to jump the start or creep on it, his own U-shaped gate will hold him back while the other U-shaped gates drop for a start.

Figure 2:
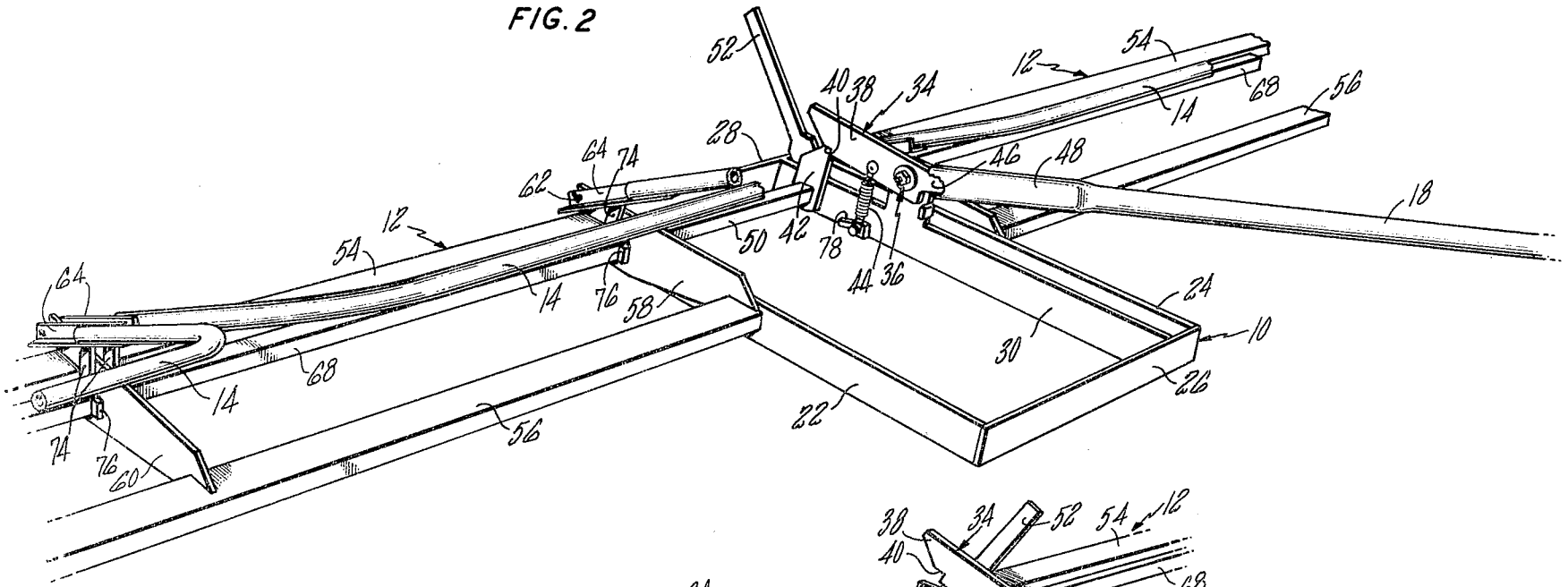
FIG. 2 is a perspective of the starting gate actuator frame and a portion of adjacent gate frame assemblies with elements in cocked, or pre-start, position.
Figure 3:
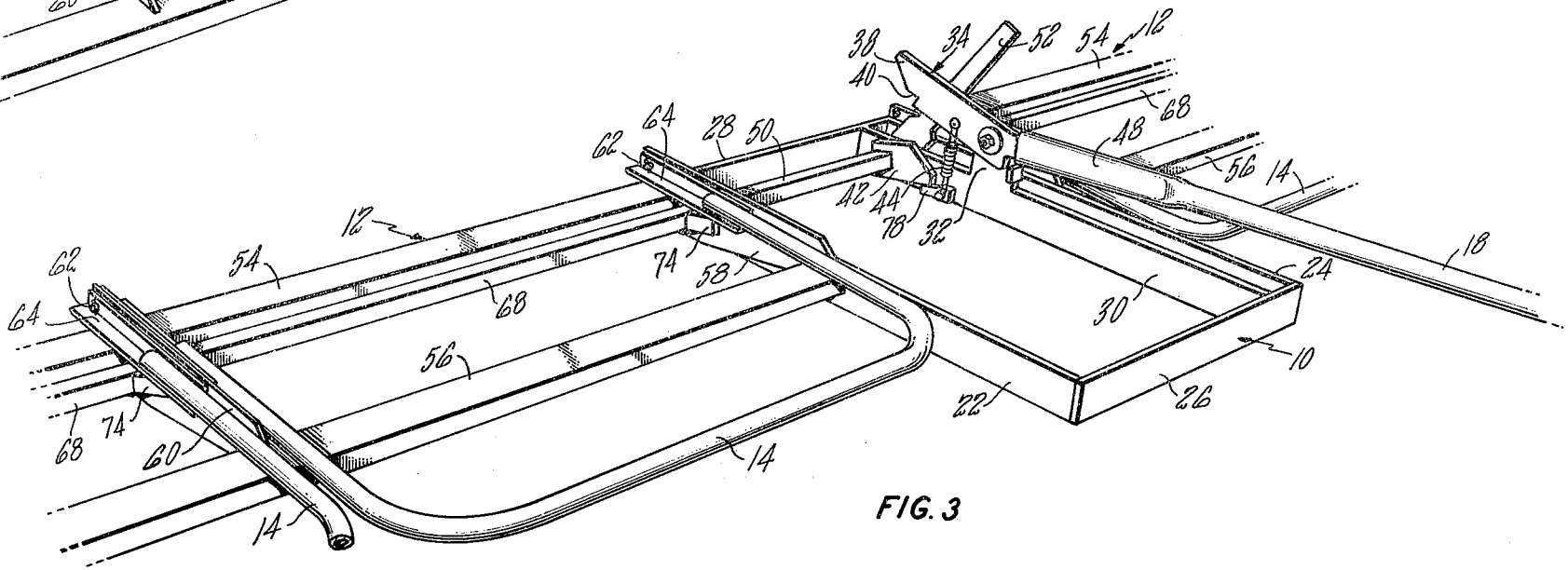
FIG. 3 shows the same starting gate structure as FIG. 2 with elements in a released, or start, position.

In FIG. 2, details of actuator frame 10 and gate frame assembly 12 may be seen. The rectangular actuator frame has side plates 22 and 24 and end plates 26 and 28. Support plate 30 extends between the end plates and is parallel to and closely adjacent side plate 24. The support plate has upwardly extending projection 32 (FIG. 3) to which V-shaped member 34 is pivotably connected by bolt and nut assembly 36. Arm 38 on member 34 has one or more notches 40 therein for receiving cocking cam 42 as will be explained and is connected by tension spring 44 to support plate 30. Arm 46 of member 34 extends in a direction opposite to arm 38 and is adopted to receive flattened end 48 of start handle 18.

Rotatable tubular shaft 50, shown here as square in section, is pivotably connected to actuator frame side plates 22 and 24, extends through support plate 30, and is parallel to and closely adjacent forward end plate 28. Cocking cam 42 is secured to the shaft adjacent to support plate 30 on the side facing side plate 22, and cocking arm 52 is secured to the shaft on the opposite side of the support plate. The cocking arm is shaped similarly to V-shaped member arm 46 so as to receive end 48 of the start handle 18. In the relative position of the parts shown in this figure, the pre-start position, cocking cam 42 is retained in notch 40 of member 34 and spring 44 tends to load the member against the cam. The cam and shaft 50 have been rotated to this position against the spring loading by using start handle 18 on cocking arm 52.

The two rectangular gate frame assemblies 12 shown in part in FIG. 2 are identical in construction and each includes one or more U-shaped gates 14. As previously stated, six U-shaped gates per gate frame assembly has been found suitable. Each gate frame assembly has front channel 54 and rear channel 56 connected by end plate 58 and another similar end plate, not shown. One or more intermediate plate 60 is provided for supporting each U-shaped gate 14, each gate section between plates defining a racer stall.

At the front channel end of each end and intermediate plate 58 and 60, respectively, a hole is provided for receiving pivot pin 62. This is the pivot about which each U-shaped gate 14 rotates when it is raised to a pre-start position and when it is dropped to a start position. U-shaped gate 14 has a short L-angle member 64 affixed to each end and these angle members have a hole in their vertical leg for pivot pin 62. Hitch-pin clip 66, FIGS. 4 and 6, is used to hold the parts in assembled position.

Rotatable tubular shaft 68, also square in section, is pivotably connected to end plates 58 and extends through intermediate plates 60 parallel to and closely adjacent front channel 54. When starting gate elements are assembled, gate frame assembly shaft 68 would be in coaxial alignment with actuator frame shaft 50, and adjacent gate frame assembly shafts would be similarly aligned. Suitable male and female fittings provide for operative connection between adjacent shafts. For example, as appears in FIG. 4, male fitting 70 which in this instance is square extends from actuator frame shaft 50 into the interior 72 of gate frame assembly shaft 68. Thus, rotation of actuator frame shaft 50 would similarly rotate all interconnected gate frame assembly shafts 68.

Figure 4:
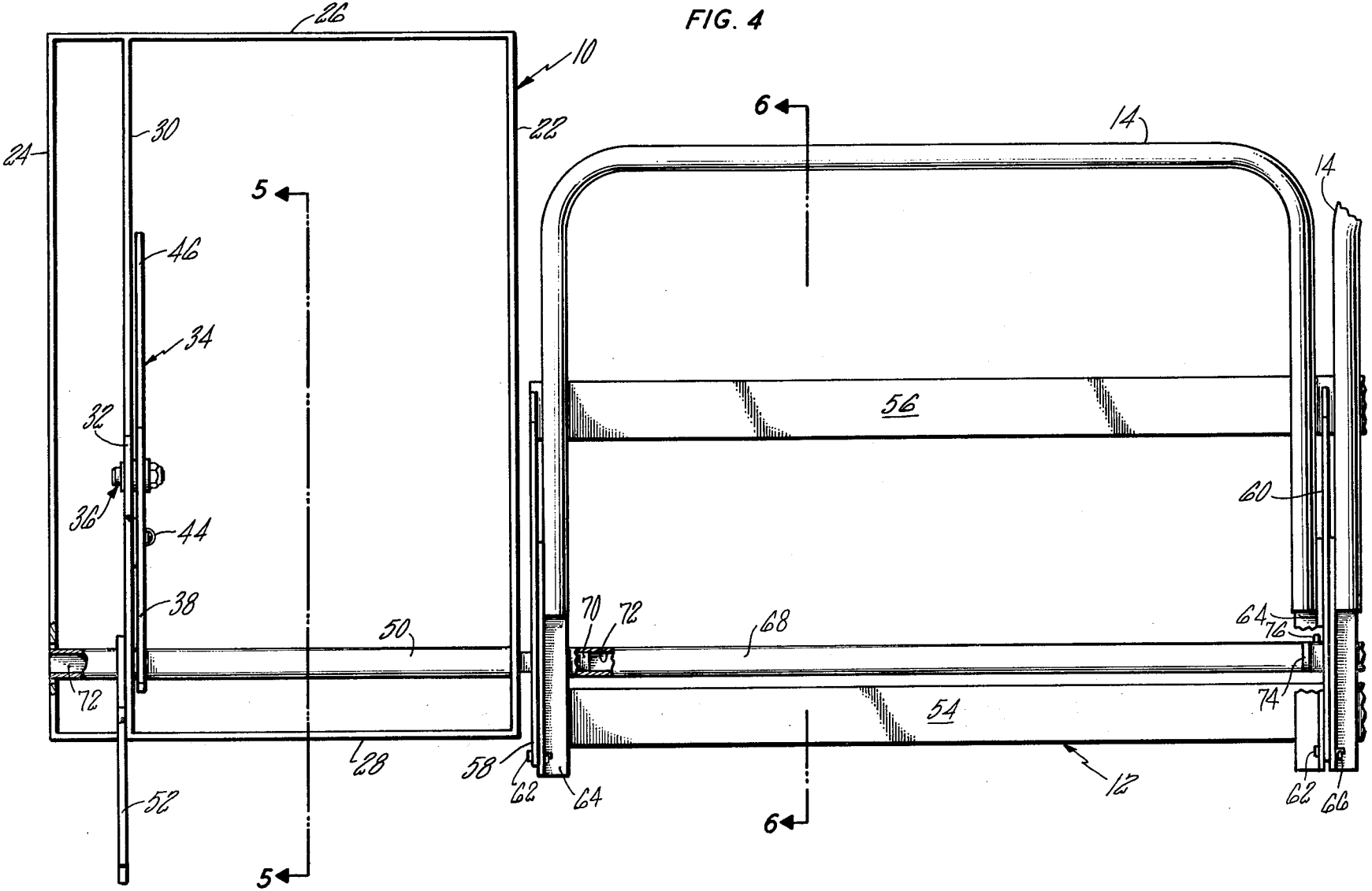
FIG. 4 is a top view of the actuator frame and a portion of an adjacent gate frame assembly showing one U-shaped gate.

Cams 74, FIGS. 2, 3, 4 and 6, are fixedly attached to gate frame assembly shaft 68 in line with each U-shaped gate L-angle member 64 and is adapted to contact the bottom of the horizontal leg of the member to hold the U-shaped gate in raised or pre-start position. Tab 76, FIGS. 2 and 4, is attached to shaft 68 at locations adjacent end and intermediate plates 58 and 60 to hold the shaft in proper longitudinal position within the gate frame assembly. It is to be noted in FIG. 6 that the portion of L-angle member 64 to the left of pivot pin 62 will act as a limit stop when it contacts the edge of front channel 54 if U-shaped gate 14 is rotated too far in a counterclockwise direction. This is a safety factor which prevents a motorcycle racer from pushing U-shaped gate 14 forward and accomplishing a false start.

When the starting gate is set up for a race, the actuator frame 10 is placed on the ground at the starting line, usually near the center of what is to be the length of the overall starting gate. As many gate frame assemblies 12 as are needed are placed in position on the ground on one or on either side of the actuator frame along the starting line with connections being made between actuator frame shaft 50 and directly adjacent gate frame assembly shafts 68, and between adjacent gate frame assembly shafts 68. The actuator frame plates and the gate frame assembly plates may be worked into the ground so that front channels 54 and rear channels 56 are approximately at ground level. A permanent type installation using timbers, asphalt or concrete could be provided for receiving the starting gate if desired.

To place the starting gate in pre-start position after the set-up has been completed, start handle 18 is placed on cocking arm 52 and the arm, together with interconnected shaft 50 and its cocking cam 42 and shafts 68 and their cams 74 are rotated to a pre-start position by moving the handle toward the front of the starting gate. The handle is moved until cocking cam 42 fits into notch 40 in arm 38 of member 34. By the use of a stepped notch or several notches, provision can be made for setting the U-shaped gates at one of several different heights depending upon the type of racing vehicle involved. The motorcycle racers then may take their starting positions in back of the raised U-shaped gates. The start handle then is placed on arm 46 of member 38. The width of actuator frame 10 and the placing of support plate 30 to one side provides space for the race starter to freely move back and forth across the starting gate without disturbing any racer and without having to go around one end of the starting gate. For the start of a race, the starter takes his place behind the starting gate and the motorcycle racers. To start the race, the starter depresses start handle 18 to rotate member 34 sufficiently far to permit cocking cam 42 to slip out of notch 40. The weight of the U-shaped gates will cause them to drop quickly and the racers may then pass over their individual section of the starting gate. Abutment 78 attached to support plate 30 limits travel of cocking cam 42 and rotation of actuator frame shaft 50 and its connected gate frame assembly shafts 68. The position of starting gate elements at a start is shown in FIG. 2.

The motion of the starter in depressing start handle 18 is relatively small, and in any event the starter is positioned behind the motorcycle racers where his movement initiating the start normally cannot be seen. Movement of actuator frame elements is relatively small, but to completely hide them from view, a covering or shield could be used for the actuator frame parts. Thus, there is essentially no tell-tale signal associated with the starting gate to prompt false or sneak starts. If desired, electrical or hydraulic actuators could be used to cock and release the gates for a race start.

Although the invention has been shown and described with respect to a preferred embodiment thereof, it should be understood by those skilled in the art that the foregoing and other changes and ommissions in the form and detail thereof may be made therein without departing from the spirit and scope of the invention, which is to be limited and defined only as set forth in the following claims.

I claim:

1. A starting gate for motorcycle racing including an actuator frame having a first pivoted member with notching means at one end and an arm at another end, first rotatable shaft means within said frame having camming means adapted to cooperate with said notching means, said rotatable shaft means having means for manually rotating said shaft, and one or more gate frame assemblies operatively connected with said actuator frame, each gate frame assembly including one or more members defining a racing stall, each of said stall defining members being pivotably mounted within said gate frame assembly, second rotatable shaft means within said gate frame assembly operatively connected to said first rotatable shaft means, and cam means on said second rotatable shaft, said cam means acting to establish the position of said stall defining members in a pre-start and a start position.

2. A starting gate for motorcycle racing according to claim 1 in which the stall defining members are of U-shape.

3. A starting gate for motorcycle racing including an actuator frame and an adjacent gate frame assembly extending alone a starting line, said actuator frame having one side adapted to be positioned along the starting line, support means in said actuator frame having a pivotable member attached thereto, rotatable means in said actuator frame parallel to said starting line and having camming means integral therewith, said pivotable member having notching means for receiving said camming means, and means integral with said rotatable means for rotating it to position said camming means in said notching means, said gate frame assembly having one side adopted to be positioned along the starting line, at least one starting stall member pivotably attached to said gate frame assembly, rotatable means in said gate frame assembly parallel to said starting line and in longitudinal alignment with said actuator frame rotatable means, means for operatively connecting said actuator frame rotatable means and said gate frame assembly rotatable means, cam means on said gate frame rotatable means to position said starting stall member in pre-start position when said actuator frame camming means is positioned in said pivotable member notching means, and means for releasing said actuator frame camming means from said notching means to permit said starting stall member to assume a start position.

4. A starting gate for motorcycle racing according to claim 3 in which said starting stall member is generally of U-shape and the base of the U faces the racing motorcycle.

5. A starting gate for motorcycle racing according to claim 3 including more than one gate frame assembly.

6. A starting gate for motorcycle racing according to claim 5 in which the gate frame assemblies are located on both sides of the actuator frame.

7. A starting gate for motorcycle racing according to claim 3 in which the actuator frame has an area for passage across the starting gate.

8. A starting gate for motorcycle racing according to claim 3 in which the actuator frame pivotable member is spring loaded against the actuator frame camming means when the camming means is in the pivotable member notching means.

9. A starting gate for motorcycle racing according to claim 4 in which the gate frame assembly includes means limiting forward rotation of the U-shaped starting stall member.

10. A starting gate for motorcycle racing according to claim 3 in which the actuator frame and the gate frame assembly are essentially rectangular in shape.

* * * * *